US011478686B2

(12) United States Patent
Guenther et al.

(10) Patent No.: US 11,478,686 B2
(45) Date of Patent: Oct. 25, 2022

(54) BAT WITH TUNABLE INSERT

(71) Applicant: Rawlings Sporting Goods Company, Inc., St. Louis, MO (US)

(72) Inventors: Doug Guenther, Wildwood, MO (US); Marc Schmidt, Weldon Spring, MO (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 278 days.

(21) Appl. No.: 16/742,243

(22) Filed: Jan. 14, 2020

(65) Prior Publication Data

US 2020/0230477 A1 Jul. 23, 2020

Related U.S. Application Data

(60) Provisional application No. 62/793,931, filed on Jan. 18, 2019.

(51) Int. Cl.

*A63B 59/00* (2015.01)
*A63B 59/58* (2015.01)
*A63B 102/18* (2015.01)

(52) U.S. Cl.

CPC ..... *A63B 59/58* (2015.10); *A63B 2059/581* (2015.10); *A63B 2102/18* (2015.10)

(58) Field of Classification Search

CPC ..... A63B 59/58; A63B 59/50; A63B 59/56; A63B 2059/581; A63B 2102/18

See application file for complete search history.

(56) References Cited

U.S. PATENT DOCUMENTS

| | | | | |
|---|---|---|---|---|
| 2011/0111894 | A1* | 5/2011 | Thouin | A63B 60/10 473/564 |
| 2012/0184402 | A1* | 7/2012 | McNamee | A63B 60/54 29/525 |
| 2018/0065011 | A1* | 3/2018 | Earley | A63B 59/51 |
| 2019/0290980 | A1 | 9/2019 | Douglas et al. | |
| 2020/0086190 | A1* | 3/2020 | Schmidt | A63B 59/56 |
| 2020/0129823 | A1* | 4/2020 | Kikuchi | A63B 59/50 |
| 2020/0230477 | A1* | 7/2020 | Guenther | A63B 59/58 |
| 2021/0205680 | A1* | 7/2021 | Pegnatori | A63B 59/58 |
| 2021/0220713 | A1* | 7/2021 | Kikuchi | A63B 60/50 |

* cited by examiner

*Primary Examiner* — Raleigh W Chiu

(57) ABSTRACT

A tunable insert is provided that may be placed within a baseball/softball bat at or near its sweet spot. The insert may allow for fine tuning of the bat's compressive strength, and thus the bat's performance. Two opposing inner sleeves may be received within a tapered inner core and may be drawn together with a threaded fastening member. When the inner sleeves are pulled together, the insert segments are pushed outward. The segmented outer piece of the insert may be directly in contact with a ring member or inner barrel that is positioned between the barrel and the tunable insert. When torque is applied to the threaded fastener, the segmented outer piece expands, thus also expanding the ring member. As the ring member expands, it gets nearer to the bat's inner surface. The relative distance of the ring member to the bat's inner surface tunes the stiffness of the bat.

13 Claims, 2 Drawing Sheets

BAT WITH TUNABLE INSERT

CROSS-REFERENCE TO RELATED APPLICATIONS

This Application claims priority to U.S. Provisional Patent Application Ser. No. 62/793,931, filed on Jan. 18, 2019, entitled "BAT WITH TUNABLE INSERT," the entire disclosure of which is incorporated herein by reference.

FIELD OF INVENTION

The present invention relates generally to a bat for use in batted ball sports like baseball or softball, and more particularly, an insert for the bat's barrel that is tunable to achieve a desired compressive strength.

BACKGROUND OF INVENTION

Numerous attempts have been made to improve the performance of a bat used in diamond sports like baseball and softball. The performance of a bat is generally based upon the weight of the bat, length of the bat, and the impact response of the bat at and during impact with a ball. Lighter weight bats typically allow a hitter to generate a greater bat speed, thus allowing for a greater batted ball speed when a player strikes a ball. As a result, much of the focus for improvements in bat technology has been on reducing the weight of a bat.

Often bat manufacturers attempt to decrease bat weight by utilizing lightweight metal structures. Because those bats use metal, the overall weight of the bat is still not dramatically affected.

The sweet spot of a bat may be many inches in length, depending on the construction of the bat. The sweet spot generally includes a point of maximum performance, at which a batted ball leaves the bat with the highest exit velocity compared to the rest of the sweet spot of the bat. The point of maximum performance is often approximately four to eight inches, and usually five to seven inches, from the end cap end of the bat barrel.

As the prior art bats have increased the performance in this area, many sports regulatory agencies have placed performance and/or configuration restrictions on the bats. For example, most regulatory bodies set a maximum performance level of a bat when a ball impacts the point of maximum performance of that bat, even as the bat "breaks in" during use. Typically, this impact performance level is measured by the exit velocity of the ball off the bat right after impact.

To create bats that meet the reduced performance level requirements, many bat makers have added stiffer materials within bat barrels. Some bats may have variable wall bat shells or inserts to limit performance. Generally, metal rings are inserted into the barrel to help offset some of the trampoline effect of the barrel of a bat during a ball strike. Foam is sometimes inserted into the barrel as well, so as to help position such metal rings within the barrel. However, such stiffening materials are not adjustable for various degrees of stiffness. Because certain players may prefer a certain degree of stiffness, a bat that has adjustable or tunable stiffness is desired.

SUMMARY OF THE INVENTION

The present invention relates to an insert that may be placed within a baseball/softball bat at or near its sweet spot that can apply a variable outward pressure against the bat wall. The insert may allow for fine tuning of the bat's compressive strength, and thus the bat's performance.

In a first embodiment, the invention utilizes a segmented insert having a tapered inner core. Two opposing inner sleeves may be received within the tapered inner core and may be drawn together with a threaded fastener. When these inner sleeves are pulled together, the insert segments are pushed outward. The outward force is proportional to the amount of torque applied to the inner threaded fastener. The segmented outer piece of the insert may be directly in contact with a ring member or inner barrel that is positioned between the barrel and the tunable insert. For example, a polymer material can be compressed between the bat barrel and insert for improved energy return.

Thus, when torque is applied to the inner threaded fastener, the segmented outer piece expands, thus also expanding the ring member. As the ring member expands, it gets nearer to the bat's inner surface until it eventually abuts it. The relative distance of the ring member to the bat's inner surface may affect the stiffness of the bat. More particularly, as the ring member gets farther from the barrel's inner wall, the barrel's sweet spot is less stiff. The invention thus allows for fine tuning or varying the compressive strength of a bat barrel.

A second embodiment may also be provided where the inner sleeves are replaced with a rotatable cam member. The cam member may be rotated by a shaft in mechanical connection with the cam member. Because the cam member has a variable circumference, depending on the relative position on the cam member relative to the variable inner walls of the insert segments, the segments may be expanded or contracted to expand or contract the ring member and adjust the bat's stiffness. In this alternative embodiment, the ring member and the bat itself may be substantially the same as in the embodiment described above including the sleeves drawn to one another to fine tune the bat.

DESCRIPTION OF THE DRAWINGS

For a better understanding of the various embodiments of the present invention, reference may be made to the accompanying drawings in which.

Figure 1:
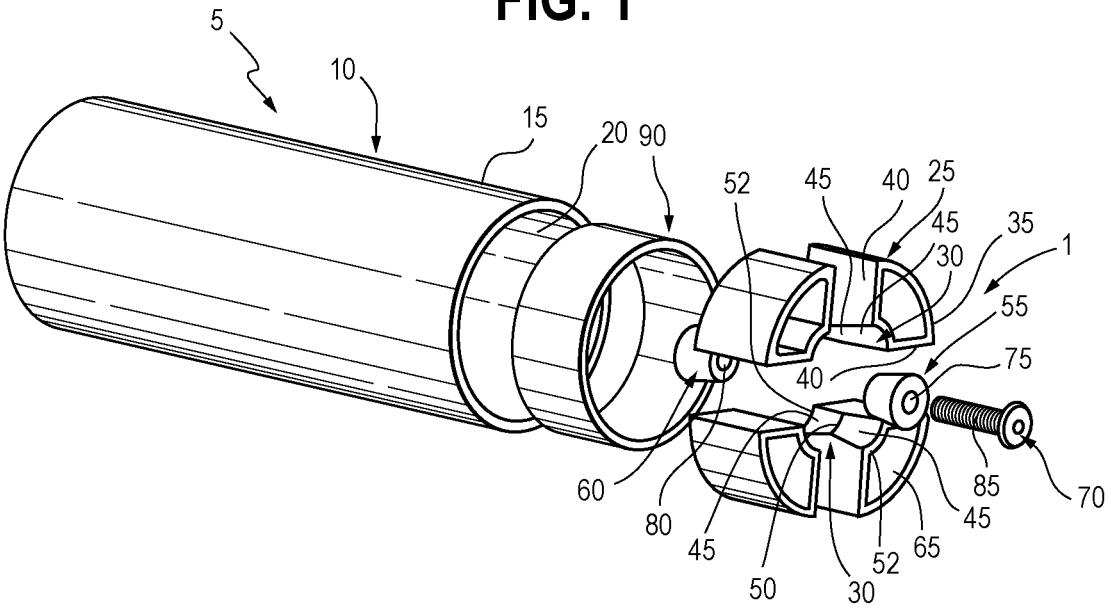
FIG. 1 is an exploded perspective view of a bat with a tunable insert constructed according to the teachings of the present invention.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 2:
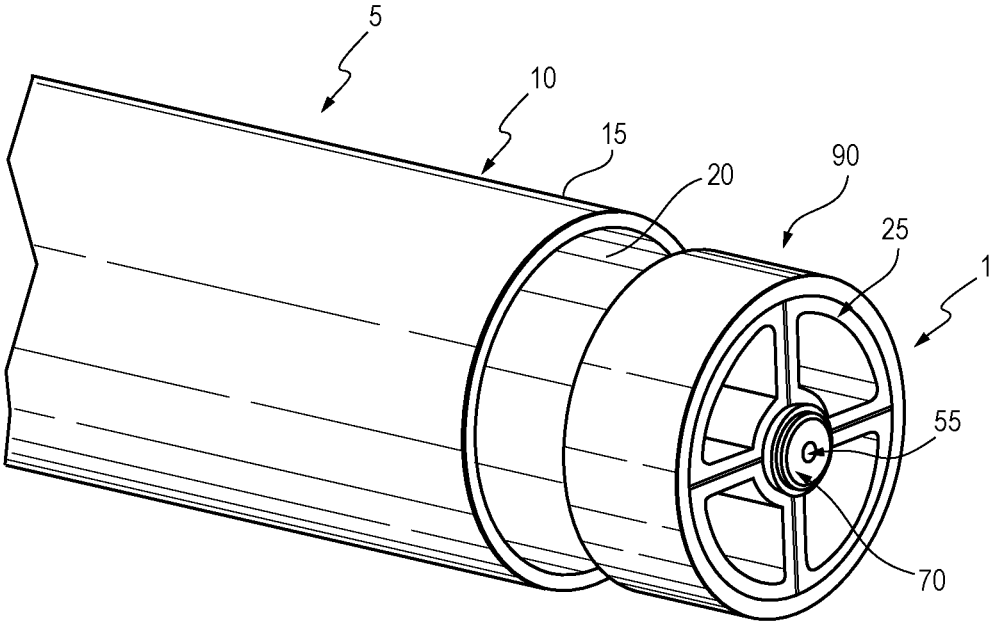
FIG. 2 is a perspective view of the bat with a tunable insert of FIG. 1.

Referring to the drawings, FIGS. 1 and 2 illustrate a tunable insert 1 that is constructed to be provided within a bat 5. In FIG. 1, various components of the insert 1 are illustrated in exploded form so as to be more clearly illustrated, and in FIG. 2 the insert 1 is shown as assembled. A distal portion 10 of a bat shell 15 is illustrated in the drawings, and like most bats, the bat 5 includes an opening 20 at its distal portion 10. Like other openings, the opening 20 may receive and secure various stiffening elements therein that act as a regulator of the performance for the bat 5.

When the insert 1 is assembled in the manner illustrated in FIG. 2, its diameter may be expanded or contracted so as to increase or decrease, respectively, the distance of the insert 1 from the inner wall of the bat 5. When the insert 1 is farther from the inner wall of the bat 5, the bat shell 15 is permitted greater deflection, and bat performance is increased. On the other hand, when the insert 1 is positioned nearer to the inner wall of the bat 5, the bat shell 15 is permitted less deflection, and bat performance is decreased. As will be described in greater detail below, the expansion or contraction of the insert 1 is driven principally by the movement of insert segments 25.

In the embodiments illustrated in FIGS. 1 and 2, the insert 1 includes four insert segments 25. Each insert segment 25 includes an inner surface 30, an outer surface 35 and side portions 40 that together form the perimeter of an individual segment 25. The inner surface 30 may include opposing tapered portions 45 that decrease in circumference as the tapered portions 45 approach a center line 50 of the inner surface 30. In other words, the cross-sectional area of each of the tapered portions 45 is greater at outer edges 52 of each tapered portion 45 than at its center line 50. The tapered portions 45 are sized and shaped so that tapered sleeve members 55, 60 (described below) may be adjustably secured therein and to one another. The process of securing the sleeve members 55, 60 closer to one another expands the insert 1. Meanwhile, the process of distancing the sleeve members from one another contracts the insert 1.

Outer portions 35 of the insert segments 25 are preferably rounded such that when the four segments 25 abut one another, a substantially circular perimeter is formed by the abutting segments 25. Side portions 40 of the segments 25 are preferably flat so that they may abut side portions 40 of adjacent insert segments 25. In the preferred embodiments illustrated herein, the segments 25 include hollow, tunneled portions 65 so as to reduce the weight of the segments 25. However, in alternative embodiments, the segments 25 may not include the hollow, tunneled portions 65.

When the insert 1 is assembled, the tapered sleeve members 55, 60 are preferably received within an aperture (not illustrated) formed between the inner surfaces 30 of the segments 25. As illustrated, the tapered sleeve members 55, 60 may have substantially circular cross-sections that decrease in circumference approaching the center line 50 of the inserts 25. This tapering for each of the sleeve members 55, 60 toward the center line 50 substantially corresponds to the tapering of the tapered portions 45 of the inner surface 30 of the segments 25. As such, when the tapered sleeve members are received within the segments 25, the sleeve members 55, 60 may substantially abut the tapered surfaces 45 of the inner surfaces 30 of the various segments 25.

When a fastening member 70 is inserted through apertures 75, 80 of the tapered sleeve members 55, 60, respectively, the fastening member 70 may be screwed or otherwise torqued to cause the tapered sleeve members 55, 60 to move closer to one another. This mechanism is carried out by threads 85 of the fastening member engaging threads within at least one of the tapered sleeve members 55, 60, as torque is applied to the fastening member 70, or the fastening member 70 is otherwise rotated, for example by a screwdriver, wrench, or by hand.

When the segments 25 are retained and engaged in the sleeve members 55, 60, a circumferential ring member 90 may also be provided that circumscribes the segments 25. The ring member 90 may secure the segments 25 therein. The ring member 90 may be made of a variety of materials, though in a preferred embodiment, it is made of a compressible polymer material. As such, it applies an inward elastic force on the segments 25 and sleeve members 55, 60. In alternative embodiments, the ring member 90 may be provided as a rubber, neoprene, or other elastic or semi-elastic materials.

When the segments 25, tapered sleeve members 55, 60, and ring member 90 are assembled to form the insert 1, the insert 1 may be placed within the opening 20 of the bat 5 as illustrated in FIG. 2. Though not illustrated, in a preferred embodiment, when the insert 1 is received within a bat such as the bat 5, it may be placed at or near the bat's barrel portion. In an example embodiment, the insert 1 may be positioned at a point of maximum performance of the bat 5, as measured prior to insertion of the insert 1. Preferably, when in place, friction secures the insert 1 within the bat 5, though other means for securing the insert 1 are foreseeable.

In operation, an operator may adjust the fastening member 70, which may be provided as a bolt, to increase or decrease radially outward pressure applied to the ring member 90. More particularly, when more pressure is provided outwardly on the ring member 90, its circumference may increase, thus causing it to approach and/or contact the inner surface of the barrel of the bat 5. When the ring member 90 is closer to the inner surface of the barrel of the bat 5 (or even abutting the inner surface of the barrel), deflection of the barrel is reduced, thus reducing the bat's performance. On the other hand, when less pressure is applied to the ring member 90, the circumference of the ring member 90 may decrease. It may therefore be positioned farther from the inner surface of the bat's barrel, thereby increasing the trampoline effect of the barrel to increase performance.

To adjust the distance of the ring member 90 from the inner surface of the bat's barrel, a user may simply apply torque to the fastening member 70. More particularly, a user may remove an end cap (not illustrated) known and understood in the art that is often used at the distal portion 10 of a bat 5. After removing the cap, the operator may use a screwdriver, wrench, or other known or foreseeable tool to tighten or loosen the fastening member 70. When the fastening member 70 is tightened, it may drive the sleeve members 55, 60 closer to one another so that more surface area of the tapered inner portions 45 and sleeve members 55, 60 abut one another. As this happens, increased outward force is applied on the segments 25. In turn, outward force may be applied to the elastic ring member 90, thus causing the insert 1 to become nearer to the inner wall of the bat.

On the other hand, to reduce the overall circumference of the insert 1 by reducing the circumference of the elastic ring member 90, a user may loosen the fastening member 70, thus causing the tapered sleeve members 55, 60 to be distanced from one another. As the sleeve members 55, 60 are distanced from one another, they may slide outwardly away from the center line 50, and allow for increased space at the center of the segments 25. The ring member 90 may thus contract, thus causing the circumference of the ring insert 1 to decrease. This increases the distance between the insert 1 and the bat's inner wall. With an increased distance between the insert 1 and the bat's inner wall, performance of the bat 5 may be increased. It will also be understood that such adjustment may occur without removal of the end cap.

Figure 3:
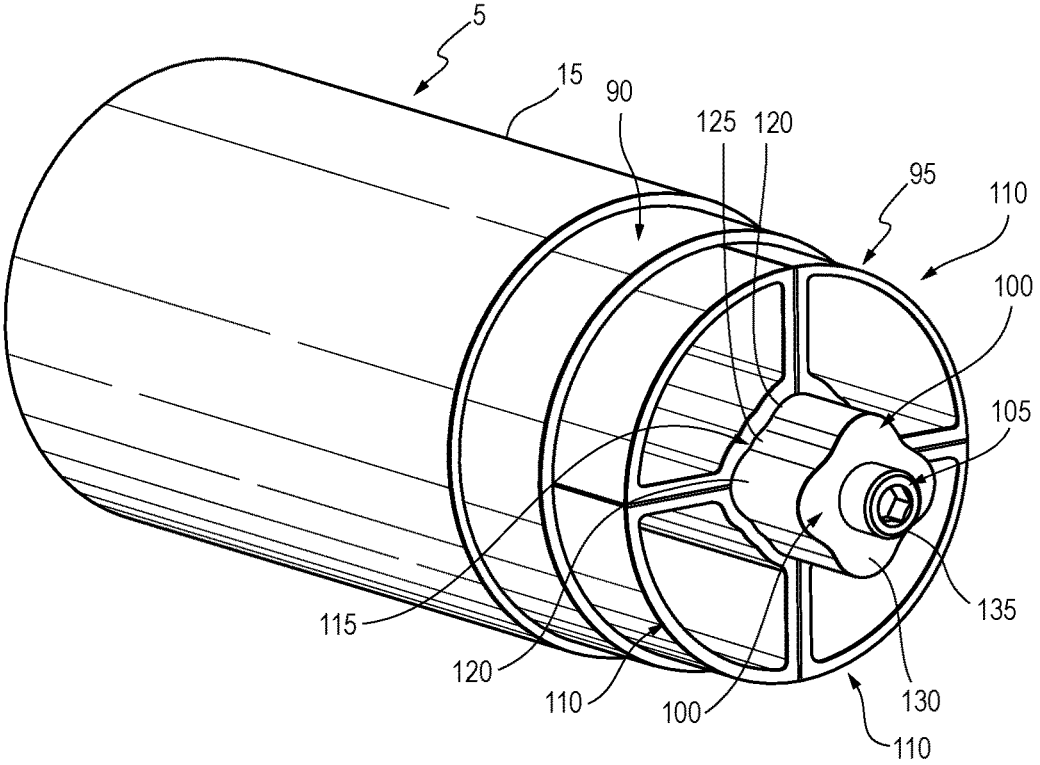
FIG. 3 is an exploded perspective view of a bat with an alternative tunable insert constructed according to the teachings of the present invention.
Figure 4:
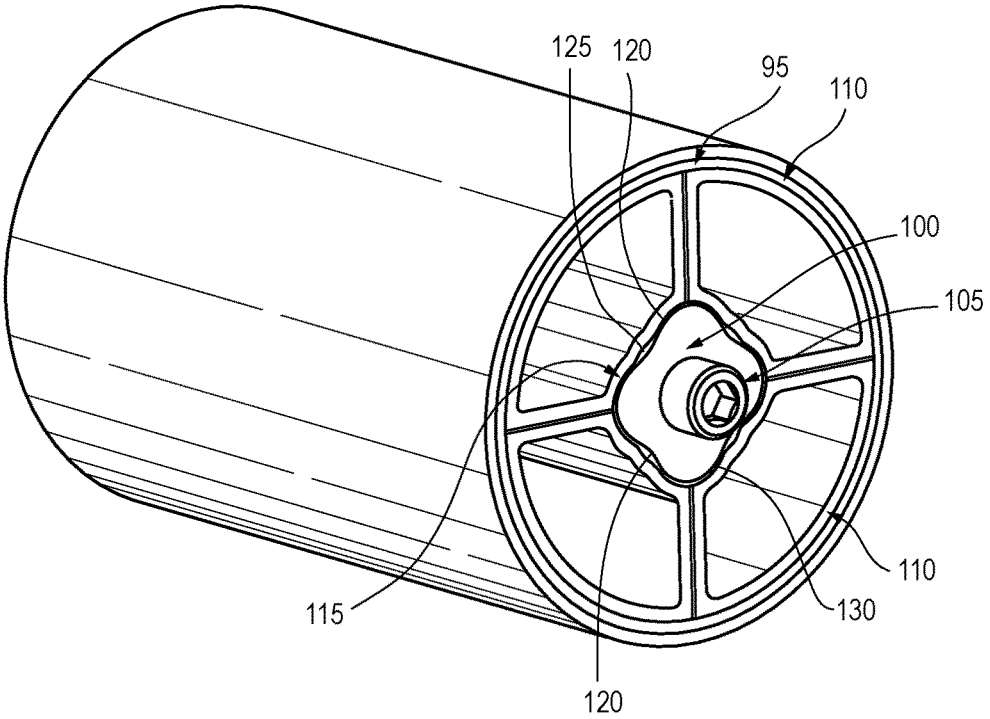
FIG. 4 is a perspective view of the bat with an alternative tunable insert of FIG. 3.

Turning to FIGS. 3 and 4, a second, alternative embodiment of the above described tunable insert 1, tunable insert 95, is illustrated. The tunable insert 95 is illustrated as used with the bat 5 and the bat shell 15 from the above-described embodiment. It should be noted that, like the insert 1, the insert 95 is designed to function with a variety of bats and/or bat shells. The insert 95 is also illustrated as used with the ring member 90 shown and illustrated with the insert 1, though other alternative embodiments are contemplated herein. The insert 95 serves the same purpose as the insert 1, namely to fine tune the stiffness of a bat such as the bat 5. Preferably, like the insert 1, the insert 95 is retained with the bat 5 by friction, though other means for securing the insert 95 within the bat 5 are foreseeable. The insert 95 uses somewhat different components and a somewhat different mechanism than the insert 1.

Unlike the insert 1, the insert 95 includes a cam member 100 and shaft member 105 in mechanical connection therewith. It also may include a number of insert segments 110 that are somewhat different in shape and structure than the insert segments 25. More particularly, the segments 110 preferably include inner walls 115 that abut the cam member 100 when the insert 95 is assembled. The inner wall 115 of each segment 110 preferably includes two outer grooves 120 and a central groove 125. The outer grooves 120 preferably are somewhat deeper than the central groove 125. This is to allow the grooves 120 and 125 to align with certain portions of the cam member 100 as the cam member 100 is rotated, as described below.

The cam member 100 preferably includes extension members 130 around its circumference. The extension members 130 are preferably formed as rounded "knob-like" protrusions that protrude outwardly from the cam member 100. At the extension members 130, the cam members 100 have an increased diameter as compared to valleys 135 between adjacent extension members 130. In the illustrated embodiment, the cam member 100 includes four extension members 130 and four valleys 135. In alternative embodiments, the cam member 100 may include more or fewer extension members 130 and/or valleys 135. The cam member 100 may be similar to other cam members in size or shape, as known or foreseeable in the art.

In operation, the cam member 100 is driven by the shaft 105, which may be driven by, for example, a screwdriver or Allen wrench. The shaft 105 may be integrally formed with the cam member 100, or it may be semi-permanently or permanently connected thereto. Thus, when the shaft 105 is rotated, so too is the cam member 100. As illustrated in FIGS. 3 and 4, the cam member 100 is positioned so that its extension members 130 are in substantial alignment with adjacent outer grooves 120 in segments 110 that are next to one another. In this position, the extension members 130 may be substantially and snugly retained within the grooves 120 of adjacent segments 110. In this configuration, the extension members 130 place little to no outward pressure on the segments 110. As a result, little to no force is applied to the ring member 90 that affects the stiffness of the bat 5, as described above when detailing the structure and operation of the insert 1. In this first position, the relative stiffness of the bat is low.

As a user rotates the shaft 105 and thus the cam member 100 from the first position toward a second position with increased stiffness, the relative position of the extension members 130 changes. More particularly, the extension members 130 rotate away from the grooves 120 having a larger diameter, and toward the grooves 125 having a smaller diameter. As the extension members 130 rotate toward the grooves 125, they apply an outward force to the segments 110 in their circumferential portions having a smaller diameter than where the grooves 120 are located. This causes the segments 110 and thus the ring member 95 to expand outwardly, thus increasing the stiffness of the bat 5. To alternate between the first and second positions herein, a user may simply rotate the shaft 105 and the cam member 100 in either direction to guide its extension members 130 from the groove 125 to the groove 120, or vice versa.

When the extension members 130 reach the grooves 125, the extension members 130 may be retained in the grooves 125 in a manner similar to how they are retained in the grooves 120 in the illustrated embodiment. In this second position, the stiffness of the bat 5 is increased relative to when the extension members 130 are retained in the adjacent grooves 120. While only two groove sizes (those associated with the grooves 120, 125) are illustrated, in alternative embodiments, more grooves may be provided. Those grooves would allow the extension members 130 to be secured in a number of variable positions between the above described first and second positions.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required."

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A bat with a tunable insert, the tunable insert comprising:

at least one tapered sleeve member; and plurality of insert segments between which the at least one tapered sleeve member may be received;

wherein when the at least one tapered sleeve member is drawn between the insert segments, the at least one tapered sleeve member applies a radially outward force to the insert segments.

2. The bat of claim 1, wherein the plurality of insert segments comprises four insert segments.

3. The bat of claim 1, wherein the at least one tapered sleeve member comprises two tapered sleeve members.

4. The bat of claim 1, wherein the tunable insert includes a fastening member in communication with the at least one tapered sleeve member.

5. The bat of claim 1, wherein the tunable insert further includes a ring member surrounding the plurality of insert segments, wherein the ring member expands when the insert segments move radially outwardly.

6. The bat of claim 5, wherein the ring member comprises a compressible material.

7. The bat of claim 1, wherein a radially inward portion of each of the insert segments is tapered.

8. A bat with a tunable insert, the tunable insert comprising:

a rotatable member; and a plurality of insert segments between which the rotatable member may be received;

wherein rotation of the rotatable member pushes the plurality of insert segments radially outwardly or allows the plurality of insert segments to move radially inwardly.

9. The bat of claim 8, wherein the rotatable member is a fastener.

10. The bat of claim 8, wherein the plurality of insert segments comprises four insert segments.

11. The bat of claim 8, wherein the tunable insert further includes a ring member surrounding the plurality of insert segments, wherein the ring member expands when the plurality of insert segments move radially outwardly and contracts when the plurality of insert segments move radially inwardly.

12. The bat of claim 11, wherein the ring member comprises a compressible material.

13. The bat of claim 8, wherein the rotatable member is a cam member.

* * * * *